United States Patent [19]

LoPresti et al.

[11] 3,943,209

[45] Mar. 9, 1976

[54] HIGH VOLUMETRIC ENERGY SMOKELESS SOLID ROCKET PROPELLANT

[75] Inventors: Arthur LoPresti, Hope; Robert P. Baumann, Dover, both of N.J.

[73] Assignee: The United States of America as represented by the Secretary of the Army, Washington, D.C.

[22] Filed: Jan. 11, 1968

[21] Appl. No.: 740,399

Related U.S. Application Data

[62] Division of Ser. No. 398,484, Sept. 21, 1964, abandoned, which is a division of Ser. No. 50,045, Aug. 16, 1960.

[52] U.S. Cl. ..... 264/3 B; 149/92; 149/93; 149/98

[51] Int. Cl.[2] ..... C06B 21/00

[58] Field of Search... 264/3 B; 149/92, 93, 94–100, 149/109

[56] References Cited

UNITED STATES PATENTS

| | | | |
|---|---|---|---|
| 1,978,071 | 10/1934 | York | 264/3 X |
| 2,946,673 | 7/1960 | Grassie | 264/3 UX |
| 3,028,274 | 4/1962 | Winer | 264/3 UX |
| 3,116,186 | 12/1963 | Paul | 264/3 X |
| 3,136,002 | 6/1964 | Schwartz | 264/3 |
| 3,211,596 | 10/1965 | Kincaid et al. | 264/3 X |
| 3,239,583 | 3/1966 | Guenter | 264/3 |
| 3,311,678 | 3/1967 | Brock et al. | 264/3 |
| 3,364,086 | 1/1968 | Oversohl et al. | 264/3 X |
| 3,378,611 | 4/1968 | Kincaid et al. | 264/3 |
| 3,379,796 | 4/1968 | Hewson et al. | 264/3 |

*Primary Examiner*—Stephen J. Lechert, Jr.
*Attorney, Agent, or Firm*—Nathan Edelberg; Robert P. Gibson; Vincent W. Cleary

[57] ABSTRACT

A method for producing high density and high energy solid propellants consisting of a solid inorganic oxidizing salt, a binder and a granular organic explosive comprising, the suspension of said ingredients in an organic solvent with agitation at ambient temperature to form a colloid, extruding the colloid, and raising the temperature to cure the grain, and the mixing of said propellant ingredients under vacuum, raising the temperature until a bulk viscosity of approximately 60,000 to 70,000 centipoises is reached, pouring said ingredients into a mold under vacuum, and curing the grains until the charge solidifies.

2 Claims, No Drawings

HIGH VOLUMETRIC ENERGY SMOKELESS SOLID ROCKET PROPELLANT

The invention described herein may be manufactured and used by or for the Government for governmental purposes without the payment to us of any royalty thereon.

This application is a division of application Ser. No. 398,484 filed 21 Sept. 1964, now abandoned. Ser. No. 398,484 is a division of application Ser. No. 50,045 filed 16 Aug. 1960.

This invention relates to solid propellants and in particular to compositions possessing high energy content per unit volume and yielding, upon burning, gases which are relatively non-smoky, non-persistent, non-toxic, and non-corrosive. These propellants are particularly useful in rockets, jatos and gas generating devices.

The maximum energy delivered by a propellant charge of fixed dimensions is determined by the specific impulse and density of the propellant; hence, it is desirable for propellants to have both high energy and high density, i.e. high volumetric energy. In addition, in most military and non-military applications of propellants, smokeless, non-corrosive, non-toxic combustion products are desirable. When weapons are fired in combat areas smoke reveals the position of the firing crew or individual. When this smoke is persistent, it obscures the target making it difficult to appraise damage or to fire follow-up rounds to prevent counter-fire. In areas involving complex equipment, engulfment by smoke makes continued operation difficult or impossible while the smoke persists. Corrosive combustion products damage equipment thereby increasing maintenance requirements or frequency of equipment breakdown or failure. Corrosive products are especially harmful in many special propellant devices requiring repeated reuse of the combustion chamber and auxiliary equipment; for example, propellant gas pressurizing devices and propellant gas-driven turbines. Toxic combustion products are harmful when personnel are subjected to significant concentrations for prolonged periods of time.

Among the various types of solid propellants in use today, there are many which yield relatively non-smoky, non-persistent, non-corrosive and non-toxic combustion products but said propellants, because of the low density of low energy of their constituents, have low energy per unit volume. High volumetric energy solid propellants are also in use today, but these, because of the nature of their constituents, yield relatively toxic, smoky, persistent and corrosive combustion products — the last three properties being especially pronounced in a humid exterior environment.

It is the object of this invention to provide propellant compositions which individually combine the advantage of high density and high energy (high volumetric energy) with favorable combustion products, i.e. those which are relatively non-toxic, non-smoky, non-persistent and non-chemically corrosive at all humidities.

Today's highest volumetric energy solid propellants contain metals, polymers and perchlorate oxidizers, hence, when burned they give off very dense solid obscuring smoke comprising the metal oxidation products. Existing propellants having the next lower level of volumetric energy contain no metal in the fuels or oxidizers but consist essentially of polymers oxidized with ammonium perchlorate. Because of the high density of the ammonium perchlorate these propellants have relatively high volumetric energy; however, the chlorine in the ammonium perchlorate produces hydrogen chloride gas when the propellant is burned. At low humidities this gas is irritating and toxic. At high humidities it forms droplets of hydrochloric acid which are highly corrosive. In addition the combustion products form a persistent, white, smoke-like fog at these high humidities.

There do exist many propellants whose combustion products are free of metallic compounds or chlorides, but these propellants have lower volumetric energy. One such type consists essentially of polymers oxidized with ammonium nitrate instead of ammonium perchlorate; however, because of the lower density and energy of ammonium nitrate the volumetric energy of these propellants is low. The highest volumetric energy smokeless propellants in use today are the double base type which consist essentially of nitrocellulose and nitroplasticizers. Even though the energies of many double base propellants equal the energies of the non-metallic fuel-ammonium perchlorate type propellants their densities are lower and consequently so are their volumetric energies.

The propellants covered by this invention provide volumetric energies higher than any of the existing ammonium nitrate or nitrocellulose-nitroplasticizer propellants yet do so without the undesirable combustion products characteristic of the existing high volumetric energy propellants discussed earlier. This results in a new class of propellants having both high volumetric energy and combustion products which are non-smoky, non-persistent and non-corrosive at all humidities. In addition, even though this new class of propellants produces carbon monoxide among its combustion products (As do the existing lower volumetric energy smokeless propellants discussed above) the overall toxicity of its combustion gases is less than that of existing high volumetric energy propellants all of which include perchlorates in their compositions. The hydrogen chloride produced by the latter propellants is toxic in much lower concentrations than carbon monoxide. Also, because the molecular weight of hydrogen chloride is higher than that of air it is less readily dispersed than carbon monoxide whose density is approximately the same as that of air. In addition, much higher concentrations of carbon monoxide than hydrogen chloride can be tolerated by humans without harmful effects. Yet, even non-dangerous concentrations of hydrogen chloride will cause discomfort to personnel due to irritation of the mucous membranes of the eyes and respiratory tracts, whereas non-dangerous concentrations of carbon monoxide will not interfere with personnel efficiency. Hence, when propellants are used in applications where the combustion gases may come into contact with personnel for extended periods, the propellants covered by this invention will have the added advantage over existing high volumetric energy propellants of reduced toxicity, discomfort and efficiency impairment of personnel.

The novelty of the propellant compositions covered by this invention and their unique combination of properties is achieved by employing in the composition in the proper proportions ingredients which yield predominantly colorless, non-corrosive gases upon decomposition. The exclusive use of organic ingredients, with essentially or substantially no inorganic halogen or metal containing constituents eliminates or minimizes the evolution of combustion products which are toxic, solid, or chemically corrosive at low humidity or which form opaque, highly corrosive and persistent condensation products at high humidities. The property of high volumetric energy is obtained by employing a high density, granular, high energy organic compound. These properties together form a unique and novel solid propellant having both high energy per unit volume and decomposition gases which cannot be readily detected, which minimize the chemical corrosion of materials with which they come in contact and which have minimal toxicity and irritability to personnel.

The compositions constituting the invention may be comprised of the following proportions of ingredients:

10% to 90% of high density, high energy, non-metallic, non-halogen, granular organic compounds 90% to 10% of a propellant matrix essentially free of metals and halogens The high density, high energy, non-metallic, non-halogen granular organic compounds may consist of any organic solids having said properties. Particularly useful for these compositions are the aliphatic nitramines wherein the nitro group is attached to an amino nitrogen atom. Some representative members of the group are cyclotetramethylene tetranitramine (HMX), cyclotrimethylene trinitramine (RDX) and ethylenedinitramine (EDNA). Other specific explosives that are suitable are pentaerythritol tetranitrate (PETN) and 2, 2, 2, trinitroethyl 4, 4, 4 trinitrobutyrate (TNETB). The above compounds may be used alone or in mixtures. This listing is by no means exhaustive and other compounds possessing these properties are apparent. The criterion of usefulness of any individual non-metal, non-halogen granular compound is that its density and energy should be high enough, relative to the particular matrix, than its incorporation in the matrix results in a net increase in volumetric energy upon combustion of the mixture.

While the energy contents of HMX and RDX are essentially equal, HMX is preferred where the highest volumetric energy is desired because its density is somewhat higher than that of RDX. Since the cost of RDX is lower than that of HMX there may be propellant applications where the lower cost will favor RDX in spite of the slightly lower volumetric energy. Similarly, mixtures of RDX and HMX in any proportions may be used as required to achieve the best compromise of cost and volumetric energy. The beta polymorph of HMX is preferred because of its lower sensitivity to shock and friction.

The propellant matix comprises any propellant which is free of halogens and metals such as mixtures of polymers, nitropolymers, and non-metal, non-halogen containing oxidizers. Propellants that have been found to be particularly suitable for use in the matrix are double base propellants. Double base propellants are compositions containing nitrocellulose and a liquid organic nitrate having the property of gelatinizing nitrocellulose. Propellants that contain solid oxidizers such as ammonium nitrate have been found to be very satisfactory. The sole important consideration in selecting the specific propellant for the propellant matrix, whether it be a double base propellant or a solid oxidizer type, is that it be free of halogens and metals. Accordingly, other propellants that can be utilized in the matrix are immediately evident to one skilled in the explosive art.

When a solid oxidizer type propellant is utilized suitable polymeric binders are used in the binder composition. These polymeric binders may be any of the well known components used in solid propellants for this purpose. To mention a few they are the synthetic rubbers, resins, polymers and nitropolymers such as polysulfide rubber, polybutadiene acrylic acid copolymer, polyurethane, nitropolyurethane and petrinacrylate. These compounds may be used for the butadiene methyl pyridine copolymer in combination with an oxidizer as shown in Example III.

The remaining plasticizers, stabilizers, and ballistic modifiers normally used with the particular propellant constitute the remainder of the binder system and they are immediately evident once the propellant is selected. The propellant matrix as a unit must be essentially free of halogens and metals.

The exact proportions of solid organic filler and propellant matric are determined by the propellant matrix used, the physical properties and volumetric energy required, and by the method of manufacture desire, whether cast, extruded or compression molded. The highest volumetric energy will be obtained with compositions in which the proportion of organic filler is highest, simultaneously this will give the most brittle physical properties and will require manufacture by compression molding or extrusion. The approximate limit of such compositions is represented by 10% propellant matrix and 90% organic filler except when the matrix selected is one consisting of a binder plus solid oxidizers In such cases the composition limit will be approximately 10% binder and 90% total solids (Solid oxidizer required in the propellant matrix plus the high density high energy organic filler). For a given propellant matrix more flexible but lower volumetric energy compositions will be obtained as the amount of propellant matrix is increased and the amount of organic filler is decreased. As the amount of filler is decreased the casting process may be used for manufacture of the propellant. The upper limit of total solids at which casting is feasible is approximately 65 to 85 percent, the exact limit depending upon the particular propellant matrix used. The approximate lower level of useful improvement in volumetric energy occurs at a level of approximately 10 percent of high density, high energy organic filler.

The propellant composition must contain between 10 and 90 percent of the high density non-metallic, non-halogen organic compound. The propellant matrix, which is essentially free of halogens and metals, is present within the range of from 10 to 90 percent of the total composition. The components that constitute the matrix can be varied within certain proportions. The matrix may consist of 90 to 10 percent by weight of the propellant, i.e. nitrocellulose, 5 to 40 percent by weight of nitroplasticizers or polymeric binders, 0.7 to 9 percent by weight of inert plasticizers, 0.1 to 1 percent by weight of stabilizers and 0.2 to 4 percent by weight of ballistic modifiers.

As examples of preferred compositions containing HMX the following are mentioned:

EXAMPLE I

| Cast Composition | |
|---|---|
| HMX, percent | 50.0 |
| Nitrocellulose, percent | 17.7 |
| Nitroglycerin, percent | 22.1 |
| Triacetin, percent | 5.2 |
| Diethylphthalate, percent | 0.5 |
| Basic lead beta resorcylate, percent | 2.0 |
| Basic cupric salicylate, percent | 2.0 |
| 2-Nitrodiphenylamine, percent | 0.5 |

EXAMPLE I-continued

| Cast Composition | |
|---|---|
| Carbon Black, percent added | (0.02) |

The nitrocellulose preferred for use in the above example is that containing an average nitrogen content of approximately 12.6 percent. The nitrocellulose is used in the form of colloided granules of substantially spherical form produced by a nitrocellulose lacquer dispersion process such as that described in U.S. Pat. No. 2,160,626. The preferred average particle size of the colloided nitrocellulose used is 20 microns or less. The preferred particle size of the HMX is 100 percent through a 20 mesh sieve and 70 to 90 percent retained on a 50 mesh sieve.

A castable explosive composition can be formed from these ingredients when all said ingredients are mixed together. Thereupon the temperature is maintained within a range of from 100° to 140°F until a bulk viscosity of approximately 60,000 to 70,000 centipoises is reached. The mixture is then poured into a mold or firing chamber of the desired size and shape. Vacuum is applied during mixing, pouring or both in order to eliminate voids in the castable material. The poured propellant is cured at 120° to 180°F until the charge solidifies.

EXAMPLE II

| Extruded Composition | |
|---|---|
| HMX, percent | 56.0 |
| Nitrocellulose (13.15%N), percent | 20.0 |
| Nitroglycerin, percent | 15.0 |
| Triacetin, percent | 4.0 |
| 2-Nitrodiphenylamine, percent | 1.0 |
| Basic lead beta resorcylate, percent | 2.0 |
| Basic cupric salicylate, percent | 2.0 |
| Carbon Black, percent added | (0.03) |

The preferred particle size distribution of the HMX in the above composition is 75 percent of the particles pass through a 50 mesh sieve but are retained on a 200 mesh sieve, and 25 percent of the particles have an average size of 15 microns.

The method of forming the propellant grains comprises mixing the ingredients together and suspending them in a suitable solvent with agitation at ambient temperature to form a colloid. Solvents that can be used are acetone, benzene, ethyl ether, and other that have a boiling point less than about 140°F. The colloid is extruded into the desired shape and the temperature is gradually raided to approximately 140°F to drive off the volatile solvent. The sizes of propellant grains which can be produced are limited by the web thickness through which complete solvent removal can be affected — generally about one-half inch. Larger propellant grains are prepared by charging small granules prepared as above into a heated press wherein the grains are consolidated and extruded into the desired size and shape.

EXAMPLE III

| | |
|---|---|
| HMX percent | 21.5 |
| Ammonium nitrate percent | 60.0 |
| Butadiene/2 methyl 5 pyridine copolymer (90/10) percent | 11.0 |
| Carbon black percent | 2.5 |
| Butyl carbitol formal percent | 2.2 |
| *Flexamine percent | 0.33 |
| Magnesium oxide percent | 0.5 |

EXAMPLE III-continued

| | |
|---|---|
| Prussian blue percent | 2.0 |

*Brown powder consisting of 65% of a complex diarylamine — ketone reaction product and 35% of N,N'diphenyl-p-phenylenediamine The above example illustrates a typical composition consisting of a propellant matrix, which is composed of a solid oxidizer (ammonium nitrate) and a binder system. The high density, high energy, granular, organic explosive is HMX. It has been calculated that there is an increase of 12.5 percent in the volumetric impulse when HMX is present in the composition in place of part of the ammonium nitrate.

Unlimited other possibilities are immediately evident to those skilled in the art of formulating and manufacturing solid propellants by using various types of essentially non metal, non halogen binder systems, such as rubbers, resins, polymers and nitropolymers, oxidized with non metal, non halogen oxidizers that are propellants; and to which is added one or a combination of high energy, high density granular organic explosive. The criterion for selecting the high density, high energy organic explosive is that, the density and energy of these materials, either singly or collectively, if more than one is used, must be such that the volumetric impulse of the resulting final propellant mixture shall be higher than that of the original smokeless propellant matrix, consisting of binder system plus oxidizer, prior to incorporation of the high energy, high density organic material.

In the above examples the compositions are not restricted to the ingredients shown nor to the exact percentages shown. Alternates may be used for or in various combinations with the above ingredients, for example: nitroplasticizers such as butanetriol trinitrate, triethylene-glycol dinitrate, diethyleneglycol dinitrate, etc., may be used for or with nitroglycerin; polymeric binders such as polyurethanes; petrinacrylates and others may be used for butadiene; plasticizers such as dimethylsebacate, adiponitrile, dimethylphthalate etc. may be used for or with triacetin or diethylphthalate; and high energy, high density, non-metal, non-halogen organic compounds such as RDX etc; may be used for or with HMX; stablizers such as ethyl centralite, n-methyl paranitroaniline etc., may be used for or with 2-nitrodiphenylamine; nitrocellulose of any nitrogen content from 12.2 to 13.15 percent may be used; suitable ballistic modifiers such as lead stannate, lead beta resorcylate, cupric salicylate, lead salicylate etc. may be used for or with the basic lead beta resorcylate or basic cupric salicylate.

The compositions given in the examples I and II discussed above have been found to produce a volumetric impulse of 14.0 lbs.-sec. per cubic inch when burned at a pressure of 1000 psi in a vessel vented with a Venturi nozzle having an expansion ratio of 4 to 1. This is approximately 37 percent higher than the highest volumetric energy existing smokeless propellants of the ammonium nitrate type, and approximately 11 percent higher than the highest volumetric energy existing smokeless propellants of the double base type. This value also exceeds by 2 percent that of the highest volumetric energy existing non-metal containing ammonium perchlorate propellant compositions whose combustion products have the undesirable characteristics eliminated by this invention. In example III cited above, the increase in volumetric impulse is approximately 12.5 percent higher than that of the smokeless propellants of the ammonium nitrate type.

We claim:

1. A method of forming high density and high energy propellants consisting of a solid inorganic oxidizing salt, a binder and a granular organic explosive comprising; mixing the propellant ingredients together and suspending said ingredients in an organic solvent selected from the group consisting of acetone, benzene, and ethyl ether with agitation at ambient temperature to form a colloid, extruding the colloid, and raising the temperature to approximately 140°F to cure said composition.

2. A method of casting high density and high energy propellants consisting of a solid inorganic oxidizing salt, a binder and a granular organic explosive comprising; mixing the propellant ingredients under vacuum, raising the temperature to within a range of from 100° to 140°F until a bulk viscosity of approximately 60,000 to 70,000 centipoises is reached, pouring said ingredients into a mold under vacuum and curing said composition at 120° to 180°F until the charge solidifies.

* * * * *